US006426701B1

(12) United States Patent
Levy et al.

(10) Patent No.: US 6,426,701 B1
(45) Date of Patent: Jul. 30, 2002

(54) HANDWASH MONITORING SYSTEM

(75) Inventors: Allan Levy, Delray Beach; James B. O'Maley, Lighthouse Pt.; Francis J. Parker, Cooper City, all of FL (US)

(73) Assignee: UltraClenz Engineering Group, Riviera Beach, FL (US)

( * ) Notice: Subject to any disclaimer, the term of this patent is extended or adjusted under 35 U.S.C. 154(b) by 0 days.

(21) Appl. No.: 09/665,970

(22) Filed: Sep. 20, 2000

(51) Int. Cl.[7] ..... G08B 23/00

(52) U.S. Cl. ..... 340/573.1; 340/539; 340/632; 340/691; 4/623; 137/552.7; 222/39; 702/176

(58) Field of Search ..... 340/573.1, 256.09, 340/539, 691, 528, 632; 137/552.7; 4/623; 702/176; 222/39

(56) References Cited

U.S. PATENT DOCUMENTS 5,202,666 A 4/1993 Knippscheer ..... 340/573.1
5,812,059 A * 9/1998 Shaw et al. ..... 340/573.1
5,900,801 A * 5/1999 Heagle et al. ..... 340/286.09
5,952,924 A * 9/1999 Evans et al. ..... 340/573.1
6,236,317 B1 * 5/2001 Cohen et al. ..... 340/573.1

* cited by examiner

*Primary Examiner*—Daniel J. Wu
(74) *Attorney, Agent, or Firm*—Jay H. Maioli

(57) ABSTRACT

A handwash monitoring system and method for providing an alert when a person must wash their hands. A badge worn by a person is activated to register at least one of a visual, audible or tactile alarm by a beacon placed where contamination may occur when the badge enters the range of the beacon. The person must wash their hands according to visual and audible prompts issued by a base unit in a wash area to clear the badge alarm.

25 Claims, 5 Drawing Sheets

PLACE HANDS UNDER FAUCET TO WET THEM
40
30
304
302
306
308
20
208
210
206
212
202
204
10
114
112
110
102
106
104
108
ABCD XYZ CORP. ID
JOAN Q. PUBLIC
ID#: 637243
SEX: F EYES: BR HT: 5-01
MANAGEMENT
JOAN Q. PUBLIC
LC

FIG. 4
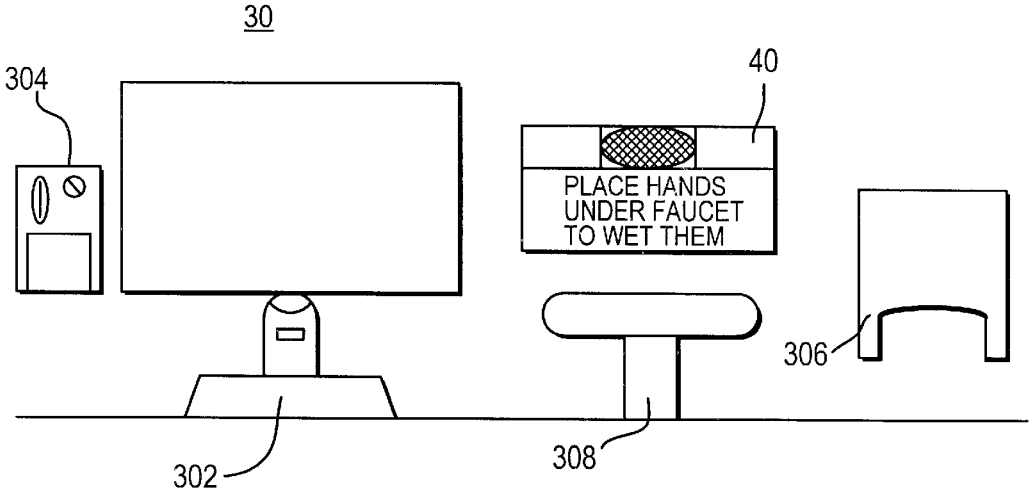
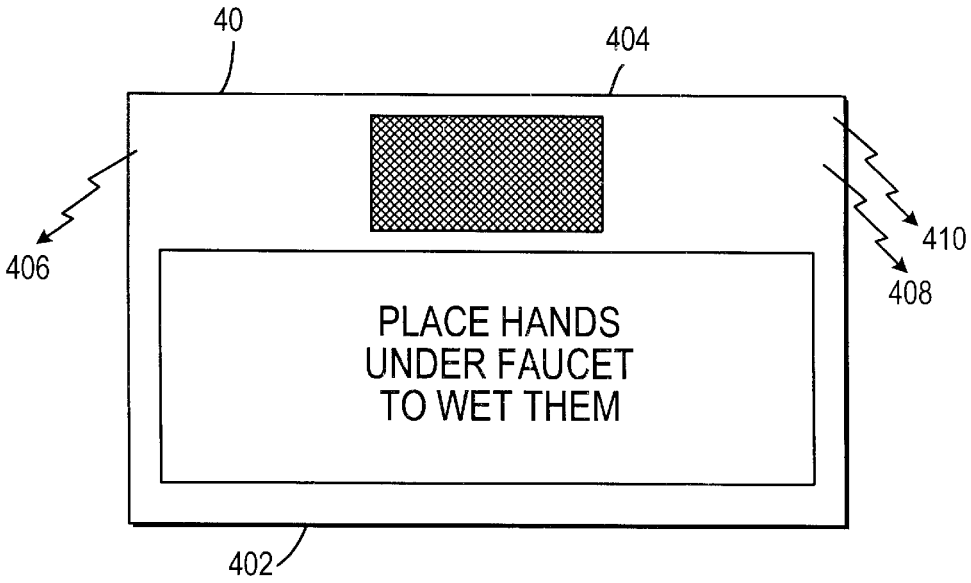
FIG. 5

HANDWASH MONITORING SYSTEM

BACKGROUND OF THE INVENTION

1. Field of the Invention

The present invention relates to a method and apparatus for handwash monitoring systems. More particularly, this invention relates to a method and apparatus wherein persons are automatically alerted to wash their hands when necessary and directed how to wash their hands step-by-step to promote adherence to government and industry hygiene standards.

2. Description of the Related Art

It is well known that maintaining a high level of employee hygiene is critical in the food service industry and healthcare professions, where the spread of bacteria and viruses can ultimately endanger a person's health. These industries must follow strict government and industry regulations requiring employees to wash their hands before and after food preparation, after handling waste, after they enter a washroom, etc. An increasing number of industries, such as microprocessor fabricators, utilize "clean" rooms or sanitary areas that rival the sterile environment of a surgical operating room. Employees are required to wash their hands according to a schedule and/or before re-entering the clean area once they have exited to avoid product contamination. As a general rule, most industries require employees to wash their hands after any bathroom use. Many industries also require washing after an employee has entered any unsanitary area, such as a garbage disposal area or hospital infectious area. Other industries may wish to alert employees to wash their hands before entering a clean room or sterile room if a requisite handwash procedure has not been performed.

Numerous inventions such as touch-free, automatic soap dispensers, faucets and hand dryers attempt to address the problem of workplace hygiene by making it easier for employees to wash their hands. Unless employees are actively supervised in the washroom, however, there is usually no way to determine if they have washed their hands. Furthermore, even if the employees do wash their hands, there is no way to easily determine if they followed a prescribed government- and/or industry-approved regimen to ensure they washed properly.

One existing system for monitoring whether employees have washed their hands uses three separate signals—one to detect that an individual has entered a washroom; a second to detect the individual has exited the washroom; and an alert signal triggered when the individual has exited the washroom without washing. The major drawback of such a system is its complexity. A control unit monitors all vital aspects of the system by analyzing and interpreting the entry and exit signals coming from separate sources to determine if hand washing must be performed. It also monitors a faucet, soap dispenser and blower to determine if hand washing is performed. The control unit issues an alert signal only if the hand washing does not occur. If any one component malfunctions, the entire system fails and employees could exit a washroom without an alert signal when no washing occurs. Another drawback of such a method is that it does not support a predetermined washing time schedule for employees. This method only requires the employee to wash when entering a washroom or other facility where it is desirable to wash before exiting. No provision is made for alerting the employee to wash their hands when the employee exits a "clean" area or sterile environment and thereafter wishes to re-enter the clean area. Finally, due to the use of entry and exit signals to function, such a system necessitates placing a washroom facility wherever there is a risk of contamination. For example, to prevent contamination from a garbage disposal area, a washroom facility would have to be installed in the garbage disposal area. This is not only impractical for existing facilities but defeats the purpose of improving overall employee hygiene.

OBJECTS OF THE INVENTION

It is an object of the current invention to solve the problems discussed above relating to monitoring employee hygiene.

Specifically, it is an object of the current invention to provide a simple handwash monitoring system that does not fail entirely if one of the system components fail. If one component should fail, the rest of the system will still function.

It is also an object of the current invention to function as more than a washroom monitor. The current invention will support a predetermined washing schedule for employees. It will also provide monitoring in a variety of other environments, such as when an employee exits a "clean" area or sterile environment.

A further object of the current invention is to solve the above problems by retrofitting existing washroom facilities. Extensive construction of new washrooms or expensive remodeling will not be required.

SUMMARY OF THE INVENTION

One embodiment of the present invention relates to a handwash monitoring system comprising: a badge worn or carried by a person for registering one of a hands-washed state and a hands-unwashed state; a wash area including a faucet and a soap dispenser for washing hands of the person; and a base unit connected to the faucet and soap dispenser for detecting when the person has correctly performed a predetermined handwash procedure, whereupon said base unit communicates with said badge to register the hands-washed state. Said badge is equipped with one or more of visual means, audible means and tactile means for registering one of the hands-washed state and the hands-unwashed state. Said base unit is equipped with one or more of visual means and audible means for prompting the person to perform the predetermined handwash procedure.

In addition, said badge comprises an identification badge with a memory containing identification data that is transmitted to said base unit upon request by said base unit to begin the predetermined handwash procedure when said badge is within a predetermined proximity to said base unit; the handwash monitoring system further comprises means for preventing reactivation of the predetermined handwash procedure for a predetermined period of time upon the base unit detecting the person has correctly performed the predetermined handwash procedure; said base unit comprises means for selecting a language for the predetermined handwash procedure based upon the identification data, stores performance data of the person regarding the predetermined handwash procedure along with the identification data transmitted by said badge to said base unit for later retrieval or for immediate or delayed transmission to a remote memory unit, and communicates with said badge using wireless means.

In this embodiment, said badge comprises a timer that triggers said badge to register the unwashed hands state after a predetermined period of time elapses. The faucet and soap dispenser in said wash area are activated by one of hand proximity sensors and non-contaminating means. The handwash monitoring system further comprises a plurality of beacons placed at locations where it is desired to communicate with said badge to register the hands-unwashed state when said badge is within a predetermined proximity to any one of said plurality of beacons; means for preventing said badge from registering the hands-unwashed state for a predetermined period of time upon said base unit detecting the person has correctly performed the predetermined handwash procedure to allow the person to exit said wash area and pass one or more of said plurality of beacons without registering the hands-unwashed state, and wherein said plurality of beacons communicate with said badge using wireless means.

The handwash monitoring system further comprises a plurality of sentinels equipped with one or more of audible means, visual means and remote means for issuing a warning when said badge is within a predetermined proximity to any one of the plurality of sentinels while registering the hands-unwashed state, wherein said plurality of sentinels detects that said badge registers the hands-unwashed state through wireless means.

In addition, the handwash monitoring system further comprises a plurality of beacon-sentinels for communicating with said badge when said badge is within a predetermined proximity to any one of said beacon-sentinels to register the hands-unwashed state in said badge and to issue a warning using one or more of audible means, visual means and remote means. Said wash area further includes an inspection device connected to said base unit for measuring an amount of soap applied on the hands of the person and/or the removal of soap from the hands of the person after rinsing.

Another embodiment of the present invention relates to a handwash monitoring method comprising the steps of: registering a hands-unwashed state on a badge worn by a person; instructing the person to perform a predetermined handwash procedure using a base unit located in a wash area; detecting whether the person has properly performed the predetermined handwash procedure using the base unit; and clearing by the base unit the hands-unwashed state on the badge when the person has properly performed the predetermined handwash procedure. Said registering step includes the step of activating one or more of a visual alarm, audible alarm and tactile alarm on the badge. Said instructing step further includes the step of one or more of visually and audibly prompting the person to perform the predetermined handwash procedure by the base unit.

In addition, the handwash monitoring method further comprises identifying the person using the base unit that prompts the badge to transmit identification data stored in the badge to the base unit to begin the predetermined handwash procedure when the badge is within a predetermined proximity to the base unit; preventing reactivation of the predetermined handwash procedure for a predetermined period of time upon the base unit detecting the person has correctly performed the predetermined handwash procedure; selecting a language for the predetermined handwash procedure using the base unit based on the identification data; and storing performance data of the person regarding the predetermined handwash procedure along with the identification data transmitted by the badge to the base unit for one of later retrieval, immediate transmission and delayed transmission to a remote memory unit. Said registering step occurs when a predetermined period of time elapses, and/or when the badge is within a predetermined proximity to any one of a plurality of beacons placed at locations where it is desired that the badge register the hands-unwashed state.

The handwash monitoring method further comprises disabling the badge from registering a hands-unwashed state for a predetermined period of time by the base unit upon detecting the person has correctly performed the predetermined handwash procedure to allow the person to exit the wash area and pass one or more of the plurality of beacons without registering the hands-unwashed state.

In this embodiment, the handwash monitoring method further comprises issuing one or more of a visual alarm, audible alarm and remote alarm by each of a plurality of sentinels when the badge registers the hands-unwashed state within a predetermined proximity to any one of the plurality of sentinels; issuing one or more of a visual alarm, audible alarm and remote alarm by each of a plurality of beacon-sentinels when the badge registers the hands-unwashed state within a predetermined proximity to any one of the beacon-sentinels; and wherein said registering step occurs when the badge is within a predetermined proximity to any one of the plurality of beacon-sentinels.

BRIEF DESCRIPTION OF THE DRAWINGS

FIG. 4 shows a representative washroom according to the present invention;

FIG. 5 shows a representative base unit according to the present invention;

DETAILED DESCRIPTION OF THE INVENTION

Figure 1:
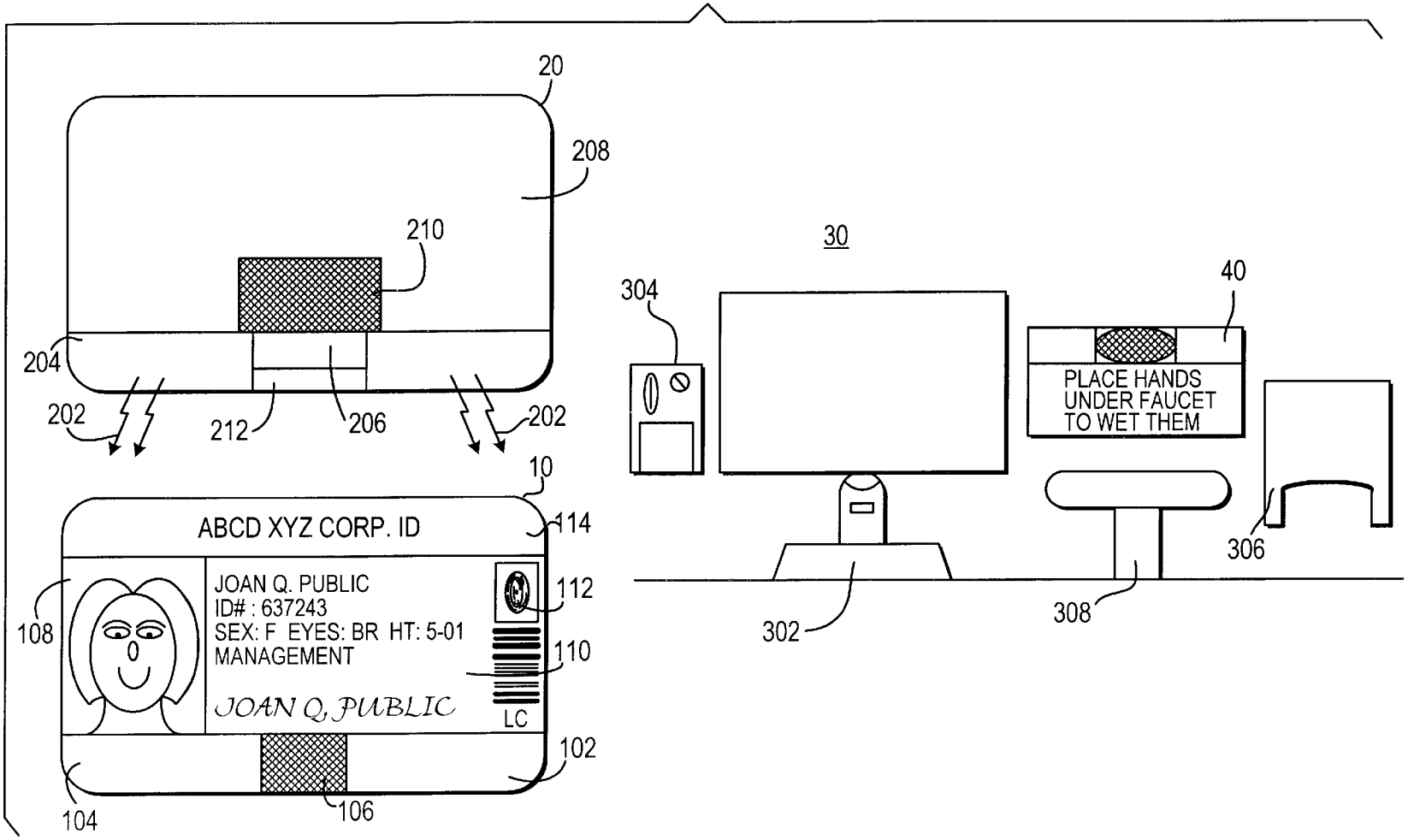
FIG. 1 shows a first embodiment of the handwash monitoring system according to the present invention.

A preferred embodiment of a handwash monitoring system is shown in FIG. 1. A badge 10 in the form of a small electronic transceiver unit that is readily worn on a person registers whether their hands are washed or unwashed. A beacon 20 is a short range radio frequency (RF) device placed wherever contamination may occur that automatically triggers the badge 10 to register the hands are unwashed. Whenever the badge 10 registers that the hands are unwashed, the person must go to a wash area 30 and wash their hands correctly in order for the badge 10 to register the hands are washed. A base unit 40 detects the approach of the person, prompts them with specific audible and/or visual directions for hand washing and monitors whether they follow the hand washing procedure. When the base unit 40 detects that the person washed their hands correctly, the base unit 40 communicates with the badge 10 to register the employee's hands are washed. The base unit 40 then transmits a delay signal 410 that activates an exit delay timer in badge 10 to keep it from registering the hands as unwashed for a predetermined period of time and to prevent the hand washing procedure from being repeated. This allows the person wearing the badge 10 to pass any beacon 20 without registering their hands are unwashed. Alternatively, the base unit 40 could be disabled from detecting the badge 10 or from reactivating the hand washing procedure for a specified period of time. A number of methods may be employed, but the aim is to keep the hand washing procedure from repeating once the person has washed their hands correctly. The specific components comprising the handwash monitoring system are discussed in detail below.

Figure 2:
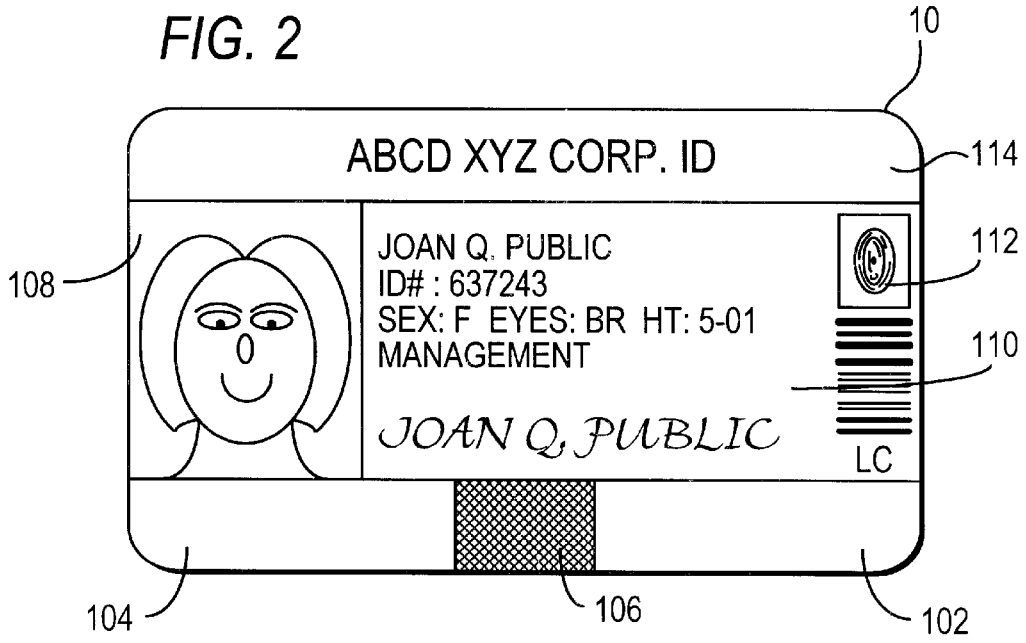
FIG. 2 shows a representative badge according to the present invention.

FIG. 2 shows a representative badge 10 according to the present invention. The preferred embodiment utilizes the badge 10 as an identification (ID) badge worn on the outside of a person's clothing. This allows easy identification of each individual being monitored, discourages switching badges with others to avoid hand washing and facilitates maintenance of each person's hand washing record in a separate memory location (not shown). Alternatively, the badge may be built into a uniform or be worn as a pager or similar device that uses any audible or visual alert to indicate the person is potentially contaminated and must wash their hands. The badge 10 may be carried by a person in their pocket, bag or in any manner that allows the person and/or their supervisor to become aware the person's hands are unwashed.

In addition to a picture 108, a person's ID information 110 (name, signature, bar code, etc.) is on the face of the badge 10 in FIG. 1. An ID memory 112 contains personal identification information. This memory could include a person's name, physical statistics, identification number, native language, etc. The badge 10 also contains a transceiver to allow communication with a beacon 20 and base unit 40. The badge 10 receives and responds to commands transmitted by the beacon 20 and base unit 40 as described herein.

The badge 10 registers a hands-unwashed state whenever it is brought within a predetermined proximity to a beacon 20. The hands-unwashed state is triggered by a trigger signal 22 transmitted by the beacon 20 and received by the badge 10. The hands-unwashed state can be registered visually by a red indicator light 104 and/or audibly by a speaker 106 transmitting an alarm. The red indicator light 104 may continuously flash for maximum visibility, begin flashing and then light steadily, simply light steadily, or use any desired combination. This allows supervisory personnel to quickly determine if a person must wash their hands and eliminates the guesswork on the part of the person in deciding whether or not it is necessary to wash their hands. The badge 10 could also be equipped to vibrate similar to a pager to alert the person their hands must be washed. Therefore, the different visual, audible and tactile alarms can be combined and tailored to suit the needs of specific industries, in accordance with the level of supervision desired. For example, an audible alarm may not be heard in a loud environment, making a visual alarm preferable. Alternatively, the badge 10 could be part of a basic monitoring system that does not utilize beacons 20 at all. In such a system, the badge 10 may or may not include any alarms and triggers the hand washing procedure under the supervision of the base unit 40 when the badge 10 is brought within a predetermined range of the base unit 40.

Additionally, the badge 10 can be equipped with a wash timer that triggers an alarm after a specified time interval. For example, a person working in a sterile environment could be required to wash their hands on a prescribed time schedule despite not having left the sterile environment to remove possible contaminants their own bodies might produce. This could eliminate the need for a beacon 20 altogether and require a person to only wash their hands on a prescribed schedule. The wash timer could also be used in addition to a system of beacons 20 placed at locations where contamination could occur.

The badge 10 registers a hands-washed state whenever the person washes their hands correctly at a wash area 30, as determined by the base unit 40. The hands-washed state is triggered by a clear signal 408 transmitted by the base unit 40 and received by the badge 10. This hands-washed state is registered visually by a green indicator light 102. The base unit 40 also transmits a delay signal 410 that activates an exit delay timer in badge 10 when the hands are washed to prevent the badge 10 from registering a hands-unwashed state for a predetermined period of time. This allows the person to pass any beacon 20, such as one typically placed outside the wash area 30 without registering their hands are unwashed. Alternatively, the base unit 40 could be disabled from detecting the badge 10 or from reactivating the hand washing procedure for a specified period of time. A number of methods may be employed, but the aim is to keep the hand washing procedure described below from repeating once the person has washed their hands correctly.

Figure 3:
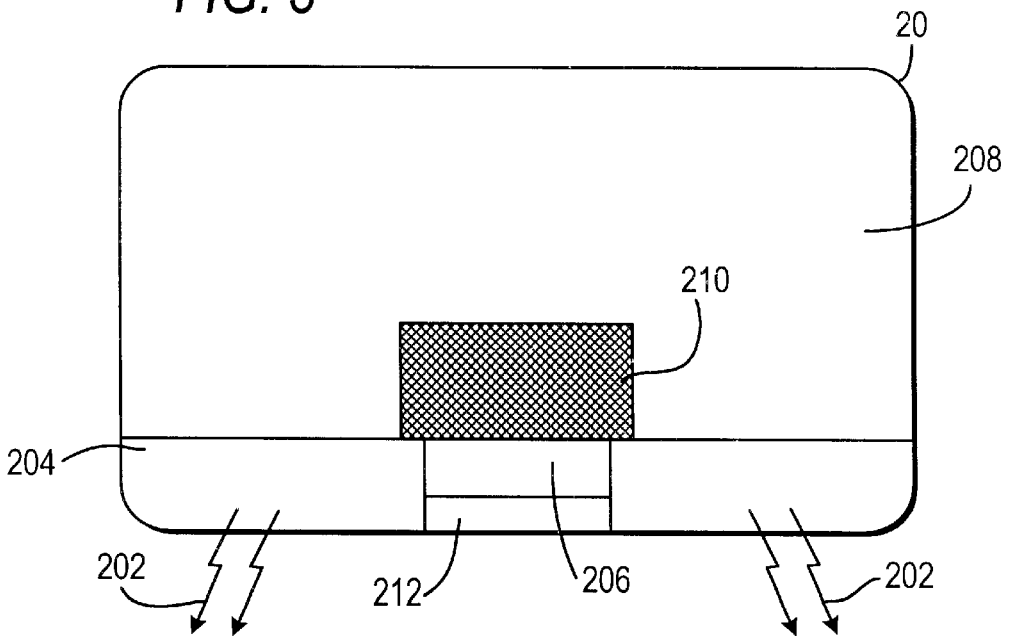
FIG. 3 shows a representative beacon according to the present invention.

A beacon 20 according to the present invention is shown in FIG. 3. The beacon 20 is a short range RF device that transmits a trigger signal 202 to a badge 10 within its range to trigger the badge 10 to register the hands-unwashed state. The beacon 20 may continuously transmit the trigger signal 202 or transmit only when a beacon motion sensor 204 is activated by movement within its range.

A beacon 20 is placed wherever there is a risk of contamination and/or wherever it is desirable for a person to wash their hands. For example, a beacon 20 could be placed outside a sterile area in a health care facility so the badge 10 of any person exiting the sterile environment registers the hands-unwashed state to warn the person to wash their hands before re-entering the sterile environment. Another typical location is outside a bathroom. A beacon 20 could also be placed in any other areas where contamination is likely, such as garbage disposals, quarantine or infectious areas.

As an optional feature, a separate sentinel unit 22 could also issue an alarm when a badge 10 in the hands-unwashed state comes within its range. The alarm can be visual by a red warning light 208 and/or audible by a beacon speaker 210 transmitting an alarm. Similar to the badge 10, the red warning light 208 could flash, light continuously or use a combination. This allows supervisory personnel to quickly determine if a person must wash their hands even if the person has somehow disabled the visual and/or audible alert on the badge 10. The alarm could be operated until the badge 10 leaves the range of the sentinel 22, or may be operated for a predetermined period of time. The sentinel 22 may be combined with the beacon 20 to provide all the above-described functions in one integrated unit.

FIG. 4 shows a representative wash area 30 according to the present invention. The preferred embodiment utilizes a touch-free faucet 302, touch-free soap dispenser 304 and an optional touch-free dryer or paper towel dispenser 306. The touch-free units are activated by triggering hand proximity sensors when a person places their hands under each unit or some other non-contaminating means, such as voice activation sensors. A base unit 40 mounted near the wash area is operatively connected to the touch-free units, and monitors the use of each unit by receiving signals from each unit as it is activated by triggering its hand proximity sensor. The touch-free units are therefore preferable to those requiring direct hand contact because the base unit 40 can utilize the pre-existing hand proximity sensors, as well as for obvious sanitary reasons. Retrofitting the base unit 40 to an existing conventional wash area, however, can be accomplished by installing applicable sensors to allow the base unit 40 to monitor a hand washing procedure using a direct contact faucet, soap dispenser and dryer.

A representative base unit 40 according to the present invention is shown in FIG. 5. A base unit 40 is mounted near each wash area 30. The preferred embodiment is equipped with a highly visible alphanumeric display 402 for displaying visual hand washing prompts and a speaker 404 for transmitting audible hand washing prompts.

The base unit 40 continuously transmits a badge interrogation signal 406 within a short range about the wash area 30. When a badge 10 is brought within range, the badge interrogation signal 406 prompts the badge's ID transmitter 114 to transmit an ID signal 116 containing the identification data stored in ID memory 112. The base unit 40 stores the identification data in an internal memory and selects a prompting language based on the identification data. In this way each person receives hand washing instructions in their native language.

The base unit 40 initiates a hand washing program and guides the person step-by-step through the hand washing procedure using visual and audible prompts with the display 402 and speaker 404, respectively. At each step the base unit 40 monitors signals received from the touch-free faucet 302, touch-free soap dispenser 304 and touch-free dryer 306 to determine if the person is carrying out the hand washing procedure as instructed. Once the person has completed the hand washing procedure correctly, the base unit 40 transmits a clear signal 408 to the badge 10 to register a hands-washed condition. This hands-washed state is registered visually by a green indicator light 102. The base unit 40 then transmits a delay signal 410 that activates an exit delay timer in badge 10 to keep it from registering the hands as unwashed for a predetermined period of time. This allows the person wearing the badge 10 to pass any beacon 20 without registering their hands are unwashed. Alternatively, the base unit 40 could be disabled from detecting the badge 10 or from reactivating the hand washing procedure for a specified period of time. A number of methods may be employed, but the aim is to keep the hand washing procedure from repeating once the person has washed their hands correctly.

Figure 6:
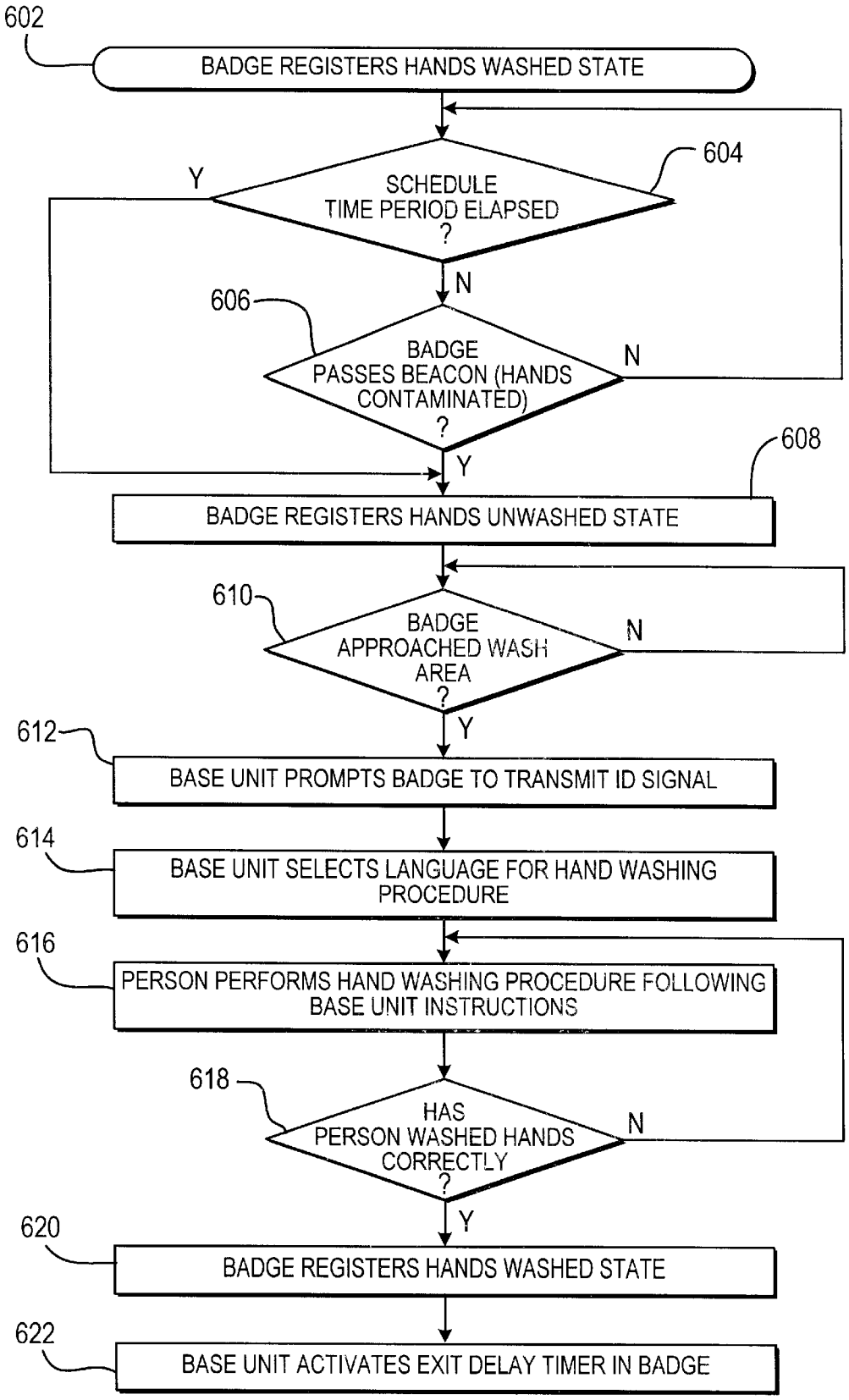
FIG. 6 is a flow chart diagram showing the overall operation of the handwash monitoring system according to the present invention.

FIG. 6 is a flow chart diagram showing the overall operation of the handwash monitoring system according to the present invention. The operation begins with the badge 10 registering the hands-washed state in step 602. If the badge 10 is equipped with an internal wash timer, step 604 is to check if a prescribed time period has elapsed. Step 606 is to check if the badge 10 has entered the range of a beacon 20 located in an area where contamination could occur. If either the prescribed time period elapses or the badge 10 enters the range of a beacon 20, the badge 10 registers the hands-unwashed state. If neither event occurs, then the badge 10 simply continues to register the hands-washed state.

When the badge 10 does register the hands-unwashed state, the person wearing the badge must wash their hands for the badge 10 to once again register the hands-washed state. Step 610 is to check whether the person with the badge 10 has approached a wash area 30. If not, the badge 10 will continue to register the hands-unwashed state. If the person approaches the wash area 30, a base unit 40 continuously transmitting a badge interrogation signal 406 prompts the badge 10 to transmit an ID signal 116 in step 612. The base unit 40 selects a language in step 614 based on the person's identification data included in the ID signal 116. This language is then used to give visual and audible prompts for a hand washing procedure performed in step 616 and described in greater detail in FIG. 7.

In step 618 the base unit 40 determines if the person performed the hand washing procedure correctly. If so, the badge 10 registers the hands-washed state in step 620 when it receives a clear signal 408 from the base unit 40. A delay signal 410 transmitted by the base unit 40 activates an exit delay timer in badge 10 in step 622. This allows the person to exit the wash area 30 and pass any beacon 20 without registering a hands-unwashed state for a predetermined period of time. It also disables the badge 10 from transmitting the ID signal 116 for a predetermined period of time to allow the person to leave the wash area 30 without triggering the hand washing procedure again.

Figure 7:
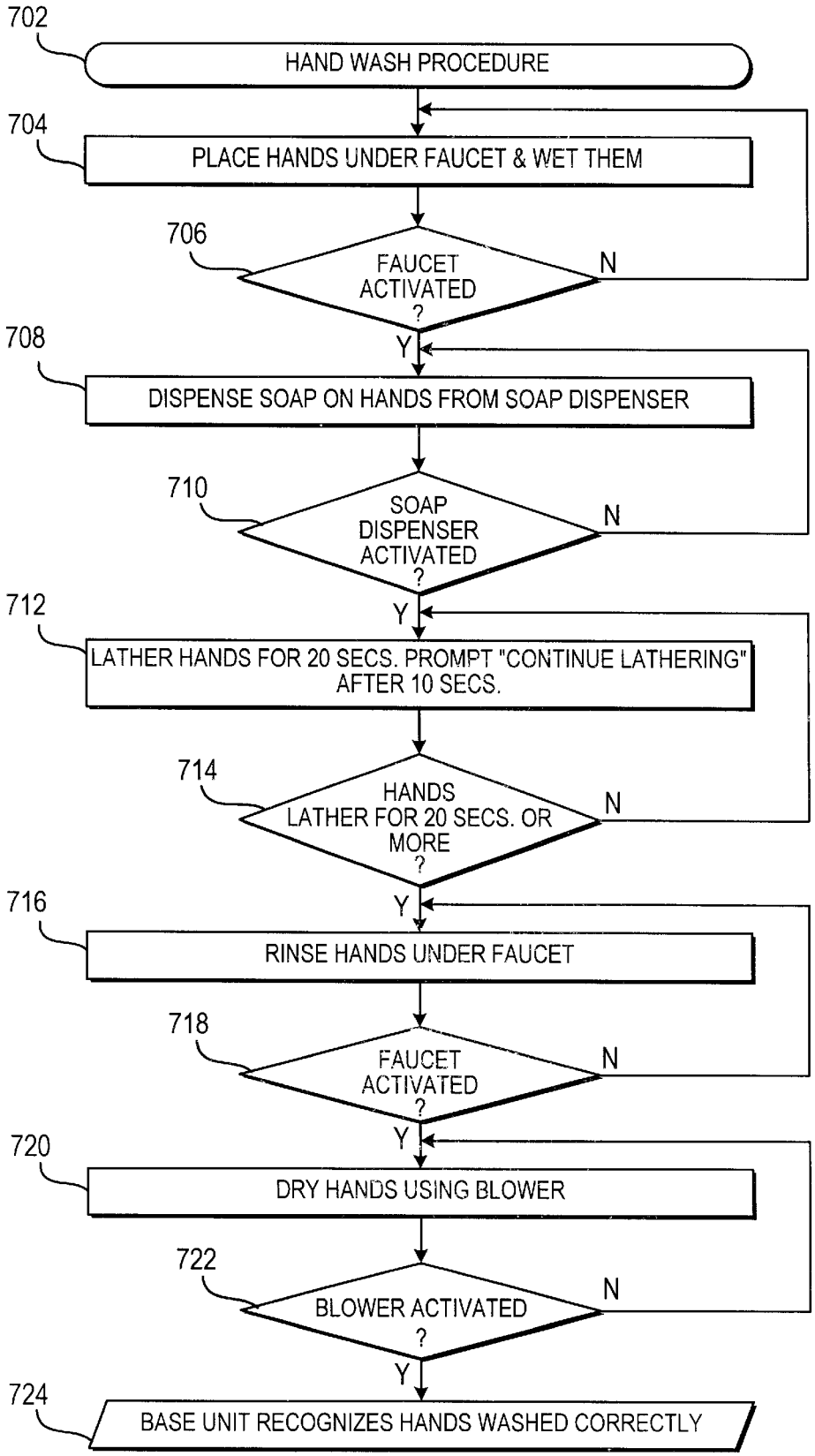
FIG. 7 is a flow chart diagram showing a representative handwash procedure.

A representative handwash procedure is shown in the flow chart diagram in FIG. 7. The procedure begins at step 702 after the person has entered the wash area 30 and the base unit 40 has determined the language to use in prompting the person visually and audibly with instructions to clean their hands. In general, any deviation from the procedure will cause the base unit 40 to repeat a portion of the procedure or the entire procedure if applicable. Only upon completion of the entire procedure is the badge 10 signaled to register the hands-washed state.

In step 704 the person is instructed to place their hands under the touch-free faucet 302 to wet them. If the base unit 40 receives a signal from the touch-free faucet 302 indicating it was activated in step 706, the procedure goes to the next washing step. Otherwise, the prompt is repeated for a predetermined period of time until the person complies.

The person is then instructed in step 708 to dispense soap on their hands from the touch-free soap dispenser 304. If the base unit 40 receives a signal from the touch-free soap dispenser 304 indicating it was activated in step 710, the procedure goes to the next washing step. Otherwise, the prompt is repeated for a predetermined period of time until the person complies.

In step 712 the person is instructed to lather their hands for twenty seconds. After ten seconds, a prompt to continue lathering is given. If the person activates any other touch-free unit before the twenty seconds elapses, the base unit 40 in step 714 prompts the person to dispense soap on their hands once again by returning to step 708. In this way the person cannot prematurely rinse or dry their hands when they should be lathered. If the twenty second time period elapses without interruption, the procedure goes to the next step.

The person is next instructed in step 716 to rinse their hands under the touch-free faucet 302. If the base unit 40 receives a signal from the touch-free faucet 302 indicating it was activated in step 718, the procedure goes to the next washing step. Otherwise, the "rinse hands" prompt is repeated for a predetermined period of time until the person complies.

In step 720 the person is instructed to dry their hands using a blower. If the base unit 40 receives a signal from the touch-free dryer 306 indicating it was activated in step 722, the base unit transmits a clear signal 408 to badge 10 to register a hands-washed state. Otherwise, the "dry hands" prompt is repeated for a predetermined period of time until the person complies.

In all of the hand washing steps discussed above, a situation may arise where the person does not comply with a given instruction but does not repeat the requested action. In each case, the base unit 40 repeats the prompt for a predetermined period of time, then resets the procedure to the beginning. In this way, the base unit 40 does not wait for a person to comply with a portion of the hand wash procedure for an inordinate period of time. Each hand washing step itself may also be timed, as in the lathering step 712. For example, it may be desirable to have a person rinse their hands for a minimum of fifteen seconds in step 716 to ensure the soap on the person's hands is completely rinsed away. The base unit 40 could time how long it receives a signal from the touch-free faucet 302 indicating it is activated. This allows greater flexibility in tailoring the hand washing procedure to comply with government, industry or personal hand washing standards.

To further ensure a person properly lathered their hands and adequately rinsed them, ultraviolet (UV) fluorescing soap may be used in the touch-free soap dispenser 304 and a touch-free inspection device 308 may be added to the wash area 30 as shown in FIG. 4. Following the "lather for twenty seconds" prompt in step 712 in FIG. 7, an additional prompt would instruct the person to place their hands under the touch-free inspection device 308. A UV detector would view an area of the hands sufficient to establish proper lathering and signal the results to the base unit 40. If adequately lathered, the hand washing procedure would proceed to the "rinse hands" prompt. Otherwise, the "lather" prompt would be repeated by the base unit 40. After rinsing the person would again be instructed to place their hands under the touch-free inspection device 308. The UV detector would determine if sufficient fluorescing soap has been removed and transmit the results to the base unit 40. If the soap has been adequately removed, the base unit 40 will transmit a clear signal 408 to the badge 10 to register the hands-washed state. Otherwise, the person would be prompted to rinse their hands again.

The internal memory of the base unit 40 stores statistics regarding current and past hand washing procedures along with the identification data of the person performing the hand washing procedure. The statistics could include a number of items such as time, date, whether the hand washing was successfully performed, the number of attempts needed to successfully perform the hand washing procedure, portions of the procedure that needed to be repeated, etc. This data can later be retrieved or transmitted to maintain and output a history record or conformance report for each person using a badge 10.

Transmitting the data to a remote computer may be accomplished by wired or wireless transmission. A read out unit temporarily connected to the base unit 40 may also be used to retrieve the data. If wired or wireless transmission is impractical, ultrasonic transmission through the wash area water plumbing may be used. Since the base unit 40 is necessarily mounted near the wash area plumbing, it could transmit data via an ultrasonic transducer attached to a local water pipe. The attached pipes act as a sonic wave guide to transmit the data to a remote transducer and receiver connected to a computer.

Similarly, ultrasound can be used for communications between badge 10, beacon 20, wash area 30 and base unit 40. The method of communication need not be restricted to RF, wired or wireless communication. Ultrasonic transmission offers an advantage over other communication methods where two wash areas are installed back to back with only a wall separating them. In such an arrangement RF or wireless signals in one wash area could interfere with the other wash area. However, the wall would block air-transmitted ultrasound.

It should also be noted that a badge 10 may have several sources of power—primary cell batteries, rechargeable cell batteries or by energy storage via energy transmitted by a beacon 20 or base unit 40. In this way the badge may be internally powered or entirely passive according to the needs and requirements of individual users. The rechargeable batteries may be charged regularly using charging units that store badges 10 of employees, for example, after the end of their work shift. The badges 10 would be recharged by the beginning of the employees' next shift.

The present invention uses a simple design that provides a great degree of reliability. In its simplest form, the system consists of a badge 10 and a base unit 40. A beacon 20 is placed wherever contamination may occur and signals a badge 10 to register a hands-unwashed state as soon as it enters the range of the beacon 20. A base unit 40 is mounted in a wash area and signals the badge 10 to register a hands-washed state when a person wearing the badge 10 washes their hands properly. The beacon 20 functions independently of the base unit 40, and each communicates independently with the badge 10. Therefore if either the beacon 20 or the base unit 40 should malfunction, the system can still function, unlike other systems which rely on a central control unit to monitor numerous sensors and issue an alert signal only if a hand washing operation does not occur. For example, if a beacon 20 should fail, there are other beacons 20 which can still signal the badge 10 to register the hands-unwashed state. Furthermore, if a person should enter a wash area 30 and their badge 10 registers a hands-washed state due to a beacon 20 malfunction, the base unit 40 will still signal the badge 10 to transmit the ID signal 116, initiate the prompts for the hand washing procedure and record the individual statistics for later analysis. While the person could potentially leave the wash area 30 without washing their hands and their badge 10 still registering a hands-washed state, a record exists that they did not wash their hands. In other systems, if a sensor located at the entrance to a washroom malfunctions, the entire system fails because the control unit will not even recognize a person has entered the washroom. In the present invention, if the base unit 40 should fail, a badge 10 will still register the hands-unwashed state whenever brought into range of a beacon 20. In other systems, if the control unit fails an-alert cannot be issued at all, so the entire system is useless.

The present invention also provides a greater degree of flexibility than previous systems. A time schedule for hand cleaning is supported. A beacon 20 can be placed remotely from a wash area 30, so the system does not merely function as a bathroom monitor. The system is easily installed in existing facilities and does not require a wash area 30 installed wherever a beacon 20 needs to be placed. A badge 10 can store a multitude of personal identification information and visual, audible and tactile ways to register a hands-unwashed state. The system also supports a variety of hand washing procedures in different languages.

The above invention has been described with specific embodiments, but a person skilled in the art could introduce many variations on these embodiments without departing from the spirit of the disclosure or from the scope of the appended claims. The embodiments are presented for the purpose of illustration only and should not be read as limiting the invention or its application. Therefore, the claims should be interpreted commensurate with the spirit and scope of the invention.

We claim:

1. A handwash monitoring system comprising:

a badge worn or carried by a person for registering one of a hands-washed state and a hands-unwashed state;

a wash area including a faucet and a soap dispenser for washing hands of the person;

a base unit connected to the faucet and soap dispenser for detecting when the person has correctly performed a predetermined handwash procedure, whereupon said base unit communicates with said badge to register the hands-washed state; and a plurality of sentinels equipped with one or more of audible means, visual means and remote means for issuing a warning when said badge is within a predetermined proximity to any one of the plurality of sentinels while registering the hands-unwashed state.

2. The handwash monitoring system as set forth in claim 1, wherein said plurality of sentinels detects that said badge registers the hands-unwashed state through wireless means.

3. A handwash monitoring system comprising:

a badge worn or carried by a person for registering one of a hands-washed state and a hands-unwashed state;

a wash area including a faucet and a soap dispenser for washing hands of the person; and a base unit connected to the faucet and soap dispenser for detecting when the person has correctly performed a predetermined handwash procedure, whereupon said base unit communicates with said badge to register the hands-washed state, wherein said badge comprises an identification badge with a memory containing identification data that is transmitted to said base unit upon request by said base unit to begin the predetermined handwash procedure when said badge is within a predetermined proximity to said base unit, and said base unit comprises means for selecting a language for the predetermined handwash procedure based upon the identification data.

4. The handwash monitoring system as set forth in claim 1, wherein said badge is equipped with one or more of visual means, audible means and tactile means for registering one of the hands-washed state and the hands-unwashed state.

5. The handwash monitoring system as set forth in claim 1, wherein said base unit is equipped with one or more of visual means and audible means for prompting the person to perform the predetermined handwash procedure.

6. The handwash monitoring system as set forth in claim 1, further comprising means for preventing reactivation of the predetermined handwash procedure for a predetermined period of time upon the base unit detecting the person has correctly performed the predetermined handwash procedure.

7. The handwash monitoring system as set forth in claim 1, wherein said base unit stores performance data of the person regarding the predetermined handwash procedure along with the identification data transmitted by said badge to said base unit for later retrieval or for immediate or delayed transmission to a remote memory unit.

8. The handwash monitoring system as set forth in claim 1, wherein said base unit communicates with said badge using wireless means.

9. The handwash monitoring system as set forth in claim 1, wherein said badge comprises a timer that triggers said badge to register the unwashed hands state after a predetermined period of time elapses.

10. The handwash monitoring system as set forth in claim 1, wherein the faucet and soap dispenser in said wash area are activated by one of hand proximity sensors and non-contaminating means.

11. The handwash monitoring system as set forth in claim 1, further comprising a plurality of beacons placed at locations where it is desired to communicate with said badge to register the hands-unwashed state when said badge is within a predetermined proximity to any one of said plurality of beacons.

12. The handwash monitoring system as set forth in claim 11, further comprising means for preventing said badge from registering the hands-unwashed state for a predetermined period of time upon said base unit detecting the person has correctly performed the predetermined handwash procedure to allow the person to exit said wash area and pass one or more of said plurality of beacons without registering the hands-unwashed state.

13. The handwash monitoring system as set forth in claim 11, wherein said plurality of beacons communicate with said badge using wireless means.

14. The handwash monitoring system as set forth in claim 1, further comprising a plurality of beacon-sentinels for communicating with said badge when said badge is within a predetermined proximity to any one of said beacon-sentinels to register the hands-unwashed state in said badge and to issue a warning using one or more of audible means, visual means and remote means.

15. The handwash monitoring system as set forth in claim 1, wherein said wash area further includes an inspection device connected to said base unit for measuring an amount of soap applied on the hands of the person and/or the removal of soap from the hands of the person after rinsing.

16. A handwash monitoring method comprising the steps of:

registering a hands-unwashed state on a badge worn by a person;

identifying the person using a base unit located in a wash area that prompts the badge to transmit identification data stored in the badge to the base unit to begin a predetermined handwash procedure when the badge is within a predetermined proximity to the base unit;

selecting a language for the predetermined handwash procedure using the base unit based on the identification data;

instructing the person to perform the predetermined handwash procedure using the base unit;

detecting whether the person has properly performed the predetermined handwash procedure using the base unit; and clearing by the base unit the hands-unwashed state on the badge when the person has properly performed the predetermined handwash procedure.

17. The handwash monitoring method according to claim 16, wherein said registering step includes the step of activating one or more of a visual alarm, audible alarm and tactile alarm on the badge.

18. The handwash monitoring method according to claim 16, wherein said instructing step further includes the step of one or more of visually and audibly prompting the person to perform the predetermined handwash procedure by the base unit.

19. The handwash monitoring method according to claim 16, further comprising preventing reactivation of the predetermined handwash procedure for a predetermined period of time upon the base unit detecting the person has correctly performed the predetermined handwash procedure.

20. The handwash monitoring method according to claim 16, wherein said handwash monitoring method further comprises storing performance data of the person regarding the predetermined handwash procedure along with the identification data transmitted by the badge to the base unit for one of later retrieval, immediate transmission and delayed transmission to a remote memory unit.

21. The handwash monitoring method according to claim 16, wherein said registering step occurs when a predetermined period of time elapses.

22. The handwash monitoring method according to claim 16, wherein said registering step occurs when the badge is within a predetermined proximity to any one of a plurality of beacons placed at locations where it is desired that the badge register the hands-unwashed state.

23. The handwash monitoring method according to claim 22, further comprising disabling the badge from registering a hands-unwashed state for a predetermined period of time by the base unit upon detecting the person has correctly performed the predetermined handwash procedure to allow the person to exit the wash area and pass one or more of the plurality of beacons without registering the hands-unwashed state.

24. The handwash monitoring method according to claim 16, further comprising issuing one or more of a visual alarm, audible alarm and remote alarm by each of a plurality of beacon-sentinels when the badge registers the hands-unwashed state within a predetermined proximity to any one of the beacon-sentinels; and wherein said registering step occurs when the badge is within a predetermined proximity to any one of the plurality of beacon-sentinels.

25. A handwash monitoring method comprising the steps of:

registering a hands-unwashed state on a badge worn by a person;

instructing the person to perform a predetermined handwash procedure using a base unit located in a wash area;

detecting whether the person has properly performed the predetermined handwash procedure using the base unit;

clearing by the base unit the hands-unwashed state on the badge when the person has properly performed the predetermined handwash procedure; and issuing one or more of a visual alarm, audible alarm and remote alarm by each of a plurality of sentinels when the badge registers the hands-unwashed state within a predetermined proximity to any one of the plurality of sentinels.

* * * * *